US006089694A

United States Patent [19]

Murakami

[11] Patent Number: 6,089,694

[45] Date of Patent: Jul. 18, 2000

[54] INK JET HEAD AND AN INK JET APPARATUS

[75] Inventor: Shuichi Murakami, Kawasaki, Japan

[73] Assignee: Canon Kabushiki Kaisha, Tokyo, Japan

[21] Appl. No.: 08/992,582

[22] Filed: Dec. 17, 1997

[30] Foreign Application Priority Data

Dec. 17, 1996 [JP] Japan ..... 8-353555

[51] Int. Cl.[7] ..... B41J 2/165; B41J 2/14

[52] U.S. Cl. ..... 347/34

[58] Field of Search ..... 347/34, 44

[56] References Cited

U.S. PATENT DOCUMENTS 4,628,331 12/1986 Ishikawa ..... 346/75

FOREIGN PATENT DOCUMENTS 0 383 019 8/1990 European Pat. Off. .
0 446 885 9/1991 European Pat. Off. .
0 469 619 2/1992 European Pat. Off. .
0 636 479 2/1995 European Pat. Off. .
0 671 268 9/1995 European Pat. Off. .
0 790 129 8/1997 European Pat. Off. .
2-088247 3/1990 Japan .
9-216354 8/1997 Japan ..... 347/34

*Primary Examiner*—Huan Tran
*Attorney, Agent, or Firm*—Fitzpatrick, Cella, Harper & Scinto

[57] ABSTRACT

An ink jet head comprises a plurality of discharge openings for discharging ink, and a facing area of the head having the plurality of discharge openings arranged in lines, and then, on both sides of the plurality of discharge openings arranged in lines on the facing area, structures are arranged with a gap over such facing area. With the structures thus arranged, the mist, which is created by the rebounded ink droplets from the surface of a recording medium at the time of impact, is prevented from adhering to the circumference of the discharge openings on the facing area of the head, hence preventing ink discharges from being disabled or twisted.

12 Claims, 12 Drawing Sheets

INK JET HEAD AND AN INK JET APPARATUS

BACKGROUND OF THE INVENTION

1. Field of the Invention

The present invention relates to an ink jet head that records by discharging ink droplets from the discharge openings to a recording medium. The invention also relates to an ink jet apparatus which is provided with such ink jet head.

2. Related Background Art

For the execution of ink jet recording, ink is discharged and impacted on a recording medium for recording. However, the ink jet recording presents a phenomenon that ink may splash about at the time of impact.

Now, with reference to FIGS. 2A to 2C and FIGS. 3A to 3C, the description will be made of the ink splash phenomenon at the time of impact.

FIG. 2A shows a head 10, a discharged droplet 12, and a recording medium 11. FIG. 2B shows the state of the droplet being impacted. FIG. 2C shows the state that the rebounded mist 14 (hereinafter also referred to simply as mist) takes place at an acute angle to the recording medium. Here, a reference numeral 13 designates an impacted ink droplet. FIGS. 3A to 3C are views which illustrate the state that a plurality of droplets are impacted on one dot formed on a recording medium. FIG. 3C shows the state that the rebounded mist 14 occurs more conspicuously at the time of impact if there is an ink droplet 15 that has been formed on the recording medium (immediately) before the current impact. Here, a reference numeral 16 designates the ink droplet which is impacted anew for the current event.

The mist thus generated at the time of impact is caused to adhere to the facing area of the ink jet head where the discharge openings are formed. This mist adhesion may result in the deviated impact or disabled discharge.

Also, an ink jet apparatus that prints color images is structured to arrange each of the ink jet heads on the same scanning line for discharging each ink of the fundamental colors. Then, during scanning performed by these ink jet heads, discharge signals are delayed for a period of time corresponding to the respective the distances between each of them so that a plurality of ink droplets, which are discharged from different ink jet heads, are overlaid on one and the same location, thus forming dots of halftone colors from the fundamental colors. For an ink jet apparatus of the kind, the generation of mist as described above is particularly conspicuous.

Therefore, it is arranged for an ink jet head of the kind to apply water-repellent agent to the facing area of the head where the discharge openings are formed so as to repel the ink droplets near the discharge openings for the prevention of any possible discharges that may be disabled or twisted.

Also, for the conventional ink jet apparatus, the facing surface is wiped or cleaned off at certain time intervals to remove the ink droplets deposited on the facing surface, thus coping with the unfavorable aspect of the operation as described above.

Also, for the ink jet recording, there is a method for using liquid that reacts upon ink (hereinafter referred to as water proof liquid) in order to provide water proof capability to the printed object.

More specifically, the water proof liquid is discharged from the ink jet head to mix it with ink on a printing medium so that the intended reaction may take place on the printing medium for the provision of the water proof capability. In other words, as in the same manner as the color ink jet recording, the water proof liquid and ink are overlaid when impacted on the printing medium.

However, for the conventional ink jet apparatus, there is such a problem as to cause the water-repellent agent formed on the head surface to be worn out when the head surface is wiped or cleaned off. Also, there is a problem that the facing area of the head is worn away by such wiping and cleaning, thus making the life of the head shorter.

Also, for the ink jet recording that uses the water proof liquid, there are some cases where firmly solidified and fixing substances may adhere to the facing area of the head due to the reaction between the water proof liquid and ink, which have splashed about the time of impact. Then, a problem is encountered that some dots may be missing in the printed images as a result of the deviated impacts or the phenomenon that ink is not discharged from the printing head in some cases.

SUMMARY OF THE INVENTION

The present invention is designed to solve those problems encountered in the prior art as described above. It is an object of the invention to provide an ink jet head capable of preventing the rebounded mist from adhering near discharge openings of the facing area of the head at the time of impact, and also, capable of attempting the prolongation of the head life by reducing the frequencies of wiping and cleaning, as well as to provide an ink jet apparatus using such head.

It is another object of the present invention to provide an ink jet head for use of the ink jet recording that uses water proof liquid, which is capable of preventing the rebounded mist from adhering to near discharge openings of the facing area of the head at the time of impact, and also, preventing the ink impact from being deviated and dots from missing when printed, as well as to provide an ink jet apparatus using such head.

In order to solve the problems described above, the present invention is designed to structure the ink jet head and the ink jet apparatus as given below. In other words, an ink jet head of the present invention comprises a plurality of discharge openings for discharging ink, and a facing area of the head having the plurality of discharge openings arranged in lines, and then, on both sides of the plurality of discharge openings arranged in lines on the facing area, structures are arranged with a gap over such facing area.

As described above, the present invention is designed to provide the structures thus formed on both sides of the discharge opening array in order to obtain the effective flow of discharges. As compared with the ink jet head having no structures of the kind on the facing area of the head, it is possible to reduce the amount of mist on the circumference of the discharge openings significantly. Also, with the reduction of wiping frequencies, the invention makes it possible to attempt the considerable prolongation of the head life.

Also, with the arrangement of the structure described above, the present invention makes it possible for the ink jet recording using the above mentioned water proof liquid to prevent rebounded mist from adhering near the discharge openings of the facing area of the head at the time of impact, hence preventing the water proof liquid from reacting upon ink to generate firmly solidified substances on the circumference of the discharge openings of the head. In this way, it becomes possible to achieve the prevention of deviated impacts and missing dots of prints when printing.

Other objective and advantages beside those discussed above will be apparent to those skilled in the art from the description of a preferred embodiment of the invention which follows. In the description, reference is made to accompanying drawings, which form a part hereof, and which illustrate an example of the invention. Such example, however, is not exhaustive of the various embodiments of the invention, and therefore reference is made to the claims which follow the description for determining the scope of the invention.

BRIEF DESCRIPTION OF THE DRAWINGS

FIG. 2A shows the relationship between a droplet discharged from printing means and a recording medium; FIG. 2B shows the state of the droplet being impacted on the recording medium; and FIG. 2C shows the state of mist being generated.

FIG. 3A shows relationship between a droplet discharged from printing means and a recording medium; FIG. 3B shows the droplet being impacted on the recording medium and FIG. 3C shows the state of more conspicuous generation of mist.

DETAILED DESCRIPTION OF THE PREFERRED EMBODIMENTS

The present invention makes it possible to prevent mist from adhering near the discharge openings of a head with the provision of structures near the discharge openings of the head as referred to in the preceding paragraphs. Now, the principle thereof will be described as given below.

Figure 4:
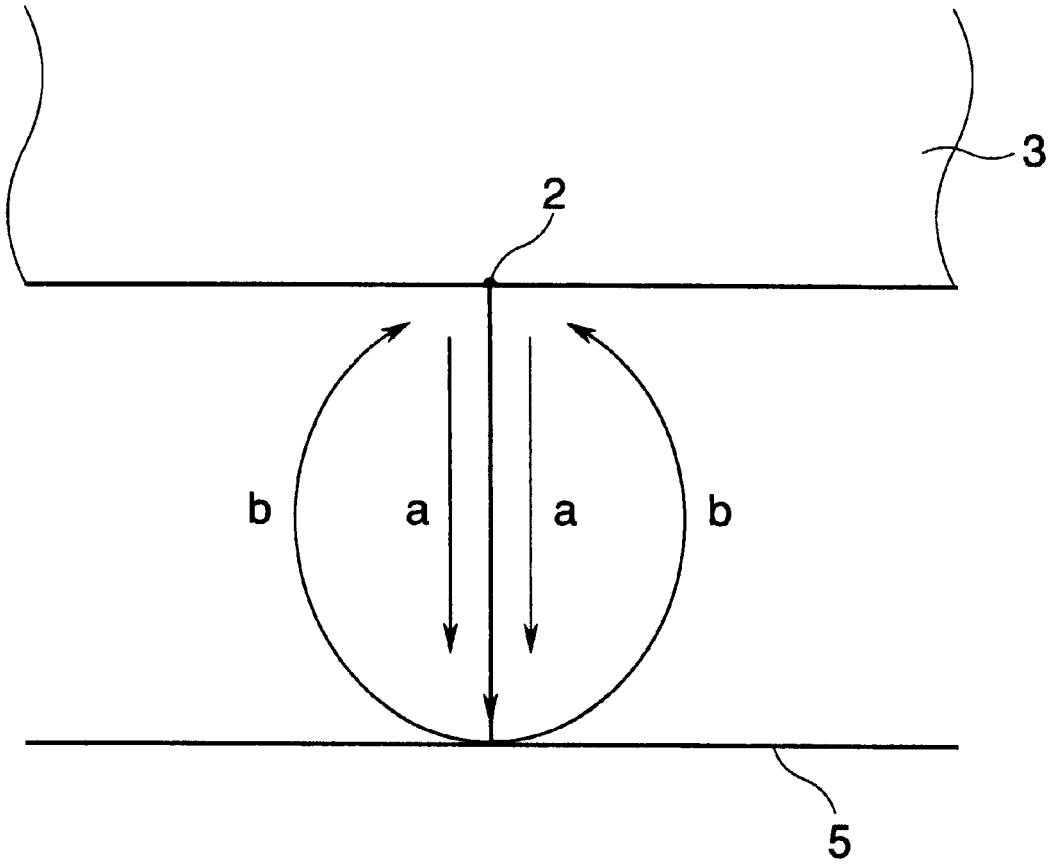
FIG. 4 is a view which theoretically illustrates the state of mist generation.

The ink droplets discharged from an ink jet head are rebounded to generate mist when impacted on a recording medium. FIG. 4 shows the behavior of such mist.

At first, the air flow is created in the same direction as the flow of discharged droplets. Such air flow is rebounded on the surface of a paper sheet.

Then, around the flow of discharged droplets is in the state of lower pressure, and the air is supplied to the atmospheric current in the same direction as the flow of such discharged droplets. As a result, the air is drawn from the circumference of such flow to generate the atmospheric current as indicated by arrows b.

Due to the atmospheric current thus generated, the mist which is rebounded slantly from the surface of the paper sheet is caused to adhere to the facing area of the head.

Therefore, in accordance with the present invention, structures are arranged on the circumference of the discharge openings of the head to prevent the generation of the atmospheric current indicated by the arrows b in FIG. 4.

Now, hereunder, the description will be made of the principle which is adopted for preventing such atmospheric current from being generated.

Figure 5:
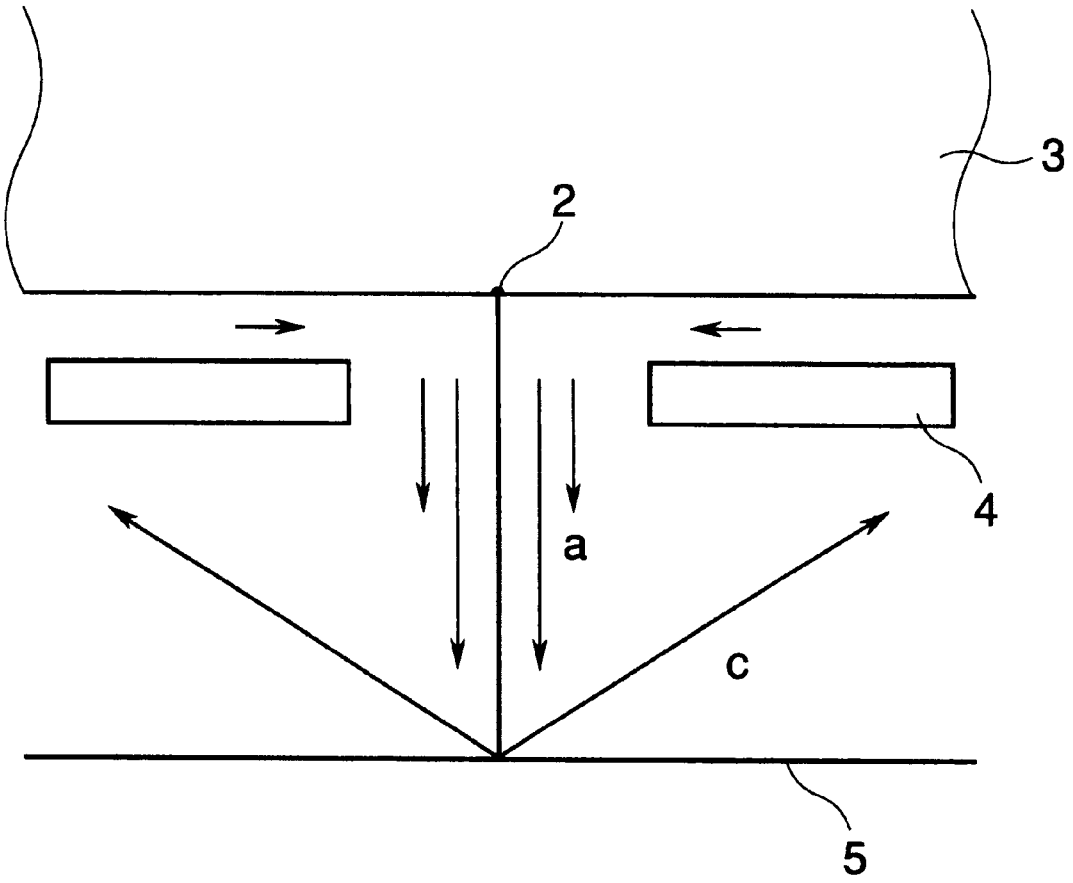
FIG. 5 is a view which theoretically illustrates the prevention of mist generation in accordance with the present invention.

As shown in FIG. 5, the atmospheric current takes place in the same direction as the flow of discharged droplets around the flow of the discharged droplets as indicated by arrows a.

In order to provide the atmospheric current continuously as indicated by the arrows a, it is necessary to supply the air to the root of such atmospheric current. In this respect, therefore, a gap is provided between the structures and the facing area of the head for the arrangement of the air supply openings.

In this way, the atmospheric current on the circumference of the discharge openings flows continuously in the direction from the facing area of the head toward the paper sheet. Then, since the mist rebounded from the surface of the paper sheet is allowed to ride on this atmospheric current, there is no possibility that the mist approaches the circumference of the discharge openings (hereinafter, this phenomenal event is referred to as discharge flow effect). Also, when the ink jet head of the present invention is mounted on a carriage, and the carriage is allowed to move for recording, the atmospheric current, which is generated along the movement of the head, functions to promote the discharge flow effect. Particularly when the head is mounted in such a way as to arrange the discharge opening array in the direction intersecting the direction of the head movement, more air is supplied to the root of such atmospheric current to enhance the anticipated effect.

Hereinafter, the description will be made of the embodiments in accordance with the present invention.

(Embodiment 1)

Figure 1:
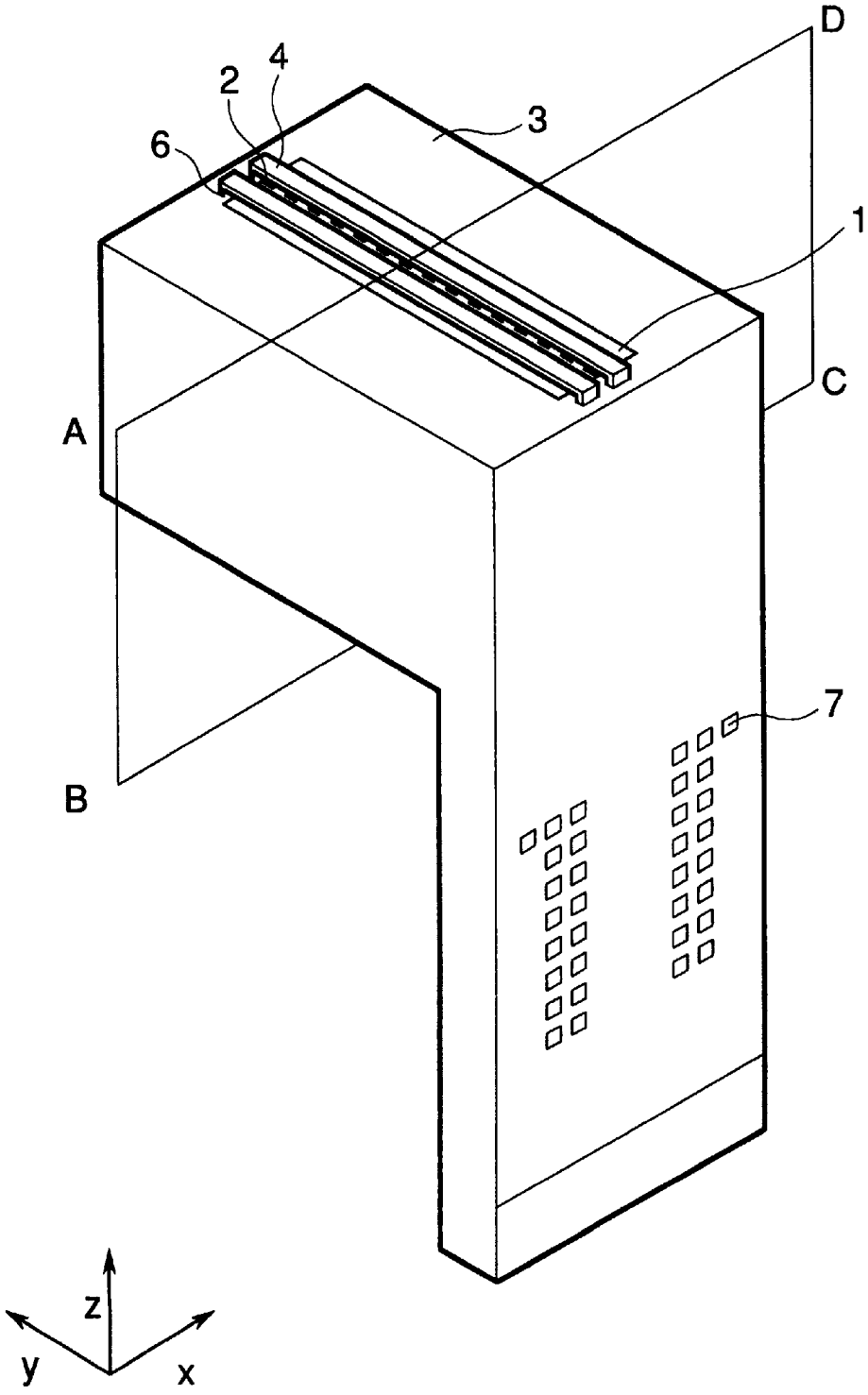
FIG. 1 is a perspective view which shows an ink jet head in accordance with a first embodiment of the present invention.
Figure 2A:
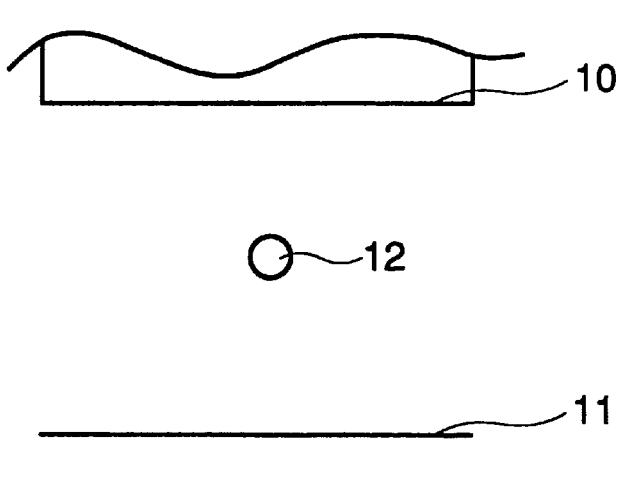
FIGS. 2A, 2B and 2C are views which illustrate the phenomenon of ink splash at the time of impact on a recording medium.
Figure 2B:
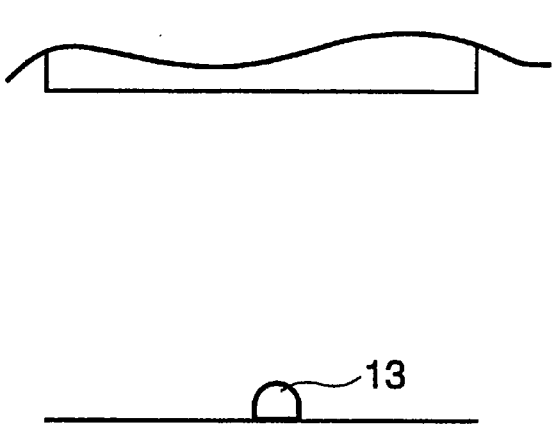
Figure 2C:
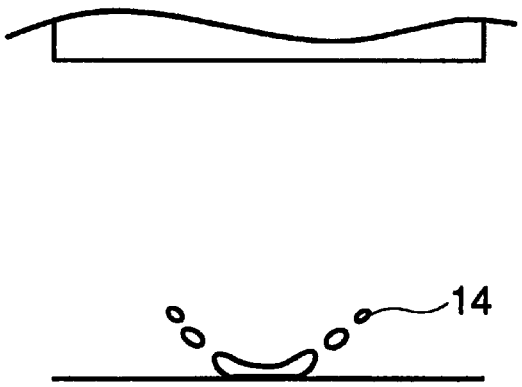
Figure 3A:
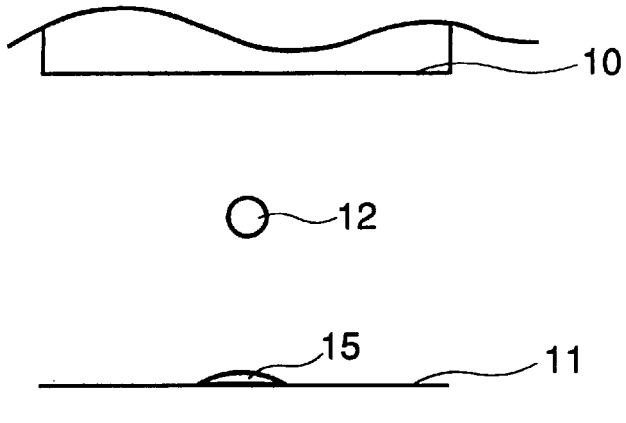
FIGS. 3A, 3B and 3C are views which illustrate the state where a plurality of droplets are impacted with time difference on one dot formed on a recording medium.
Figure 3B:
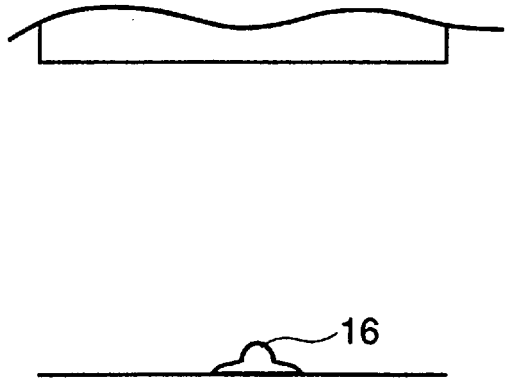
Figure 3C:
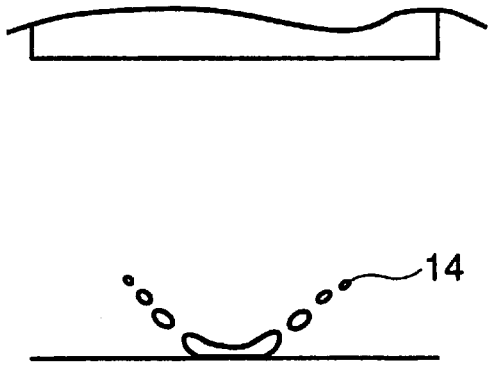

FIG. 1 is a perspective view which shows an ink jet head in accordance with a first embodiment of the present invention.

In FIG. 1, a reference numeral 1 designates a head chip having the discharge openings formed to discharge ink; 2, the discharge openings arranged in lines on the head chip for discharging ink; 3, a supporting member to which the head chip is fixed; and 7, contact pads serving as means for conductively connecting the ink jet head and the recording apparatus electrically.

In accordance with the present embodiment, the dimension of the structure 4 arranged on the circumference of the facing area of the ink jet head is 0.2 mm thick, 0.8 mm long in the direction x, and 2.00 mm long in the direction y.

Also, the gap between the structure 4 and the facing area of the head is 0.2 mm, and the distance between each of the structures 4 is 0.7 mm.

Ribs 6 each integrally formed with the structure 4 are provided to fix each of the rectangular bodies of structures 4 to the head. The dimension of such rib 6 is 0.8 mm long in the direction x, and 0.3 mm long in the direction y. Also, SUS is used as material of the structure 4.

For the ink jet head, the discharge openings are arranged on the head chip 1 in a discharge density of 600 DPI with the discharge volume of 8.5 $\mu$l at the discharge speed of 18 m/s. Here, the ink jet apparatus using this head is not shown in FIG. 1.

In accordance with the present embodiment, the head can print both on the forward and backward movements of the carriage on which it is mounted. The distance between the discharge openings and the paper sheet is 1.5 mm, and the driving frequency is 8 kHz.

Figure 6:
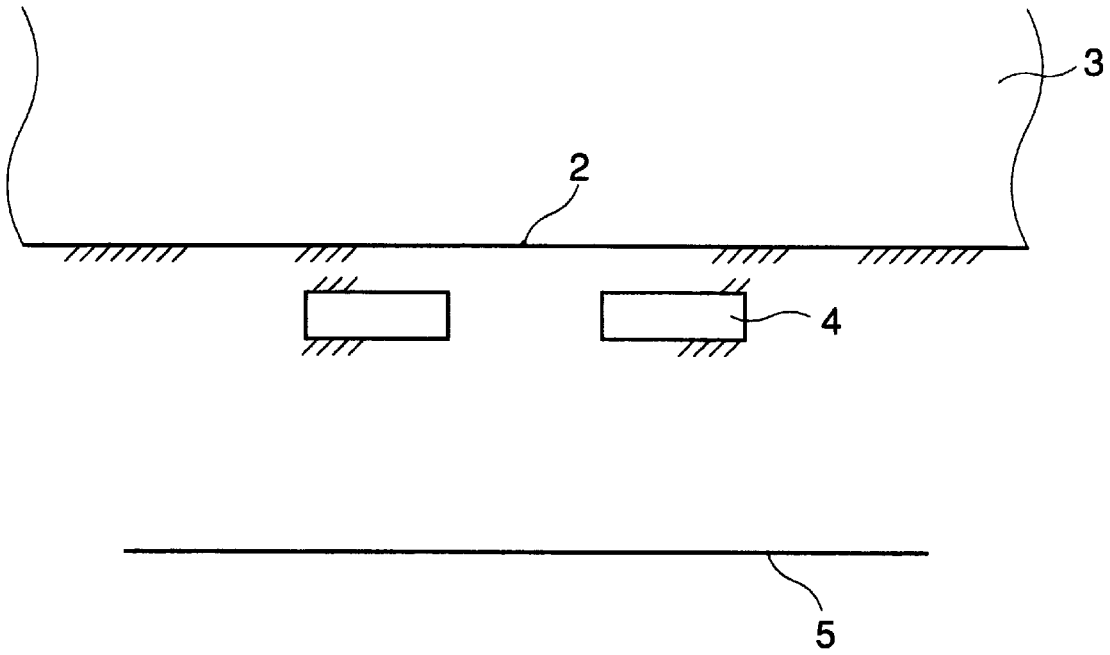
FIG. 6 is a view which shows the circumference of discharge openings of a head of the ink jet head represented in FIG. 1, taken along the section indicated by marks A, B, C, and D in FIG. 1.

FIG. 6 shows the circumference of the head discharge openings, taken along the section indicated by marks A, B, C, and D in FIG. 1.

In FIG. 6, a reference numeral 5 designates a paper sheet on which ink forms images.

With the structure thus arranged in accordance with the present embodiment, the facing area of the ink jet head is observed after printing. Then, it is found that mist adheres only to the portions indicated by slanted lines.

In other words, mist adheres to the gap between each structure 4 and the facing area of the head. However, mist remains on such portions, and it is not allowed to reach the circumference of the discharge openings 2.

In this way, as compared with the ink jet head without the provision of structures 4, the amount of adhesive mist on the circumference of discharge openings is reduced significantly by the discharge flow effect.

As a result, the frequencies of wiping can be reduced as compared with the conventional ink jet apparatus, making it possible to prolong the life of the head accordingly.

In accordance with the present embodiment, the thickness of the structure 4 is 0.2 mm, but it may be possible to make the length of the structure anyway if only the total length, which is the sum of the gap between the structure and the head facing area, and the thickness of the structure, is smaller than the distance between the facing area of the head and the paper sheet.

Also, for the material of the structure 4, plastics, such as PET or polypropylene, may be used instead of SUS.

Figure 7:
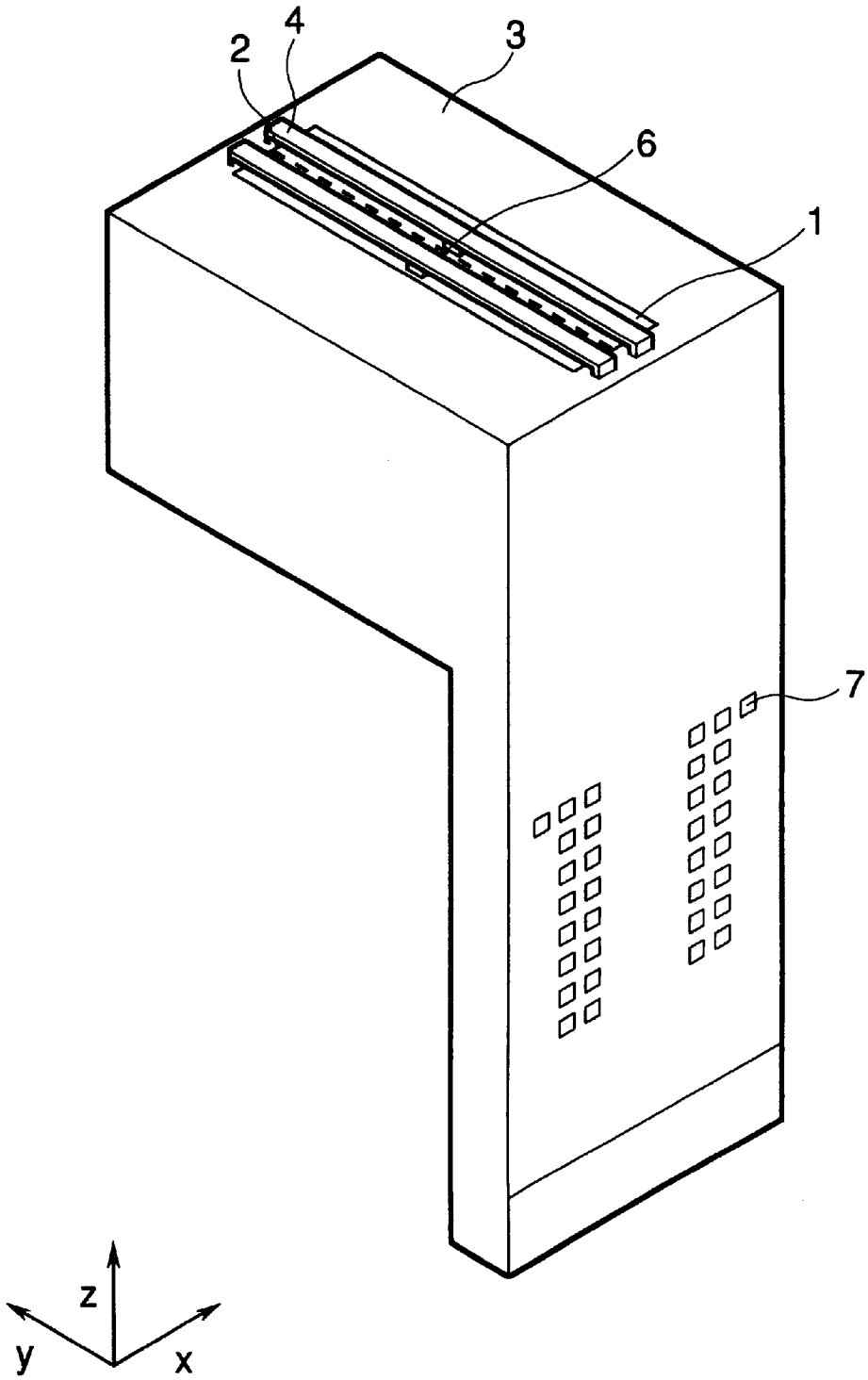
FIG. 7 is a perspective view showing the ink jet head on which ribs are arranged in gaps between the structure and the facing area of the head as one mode of the first embodiment in accordance with the present invention.

When such plastic material is used, ribs 6 are arranged for each of the gaps between the structures 4 and the head facing area in order to hold the strength of each structure as shown in FIG. 7.

Figure 8:
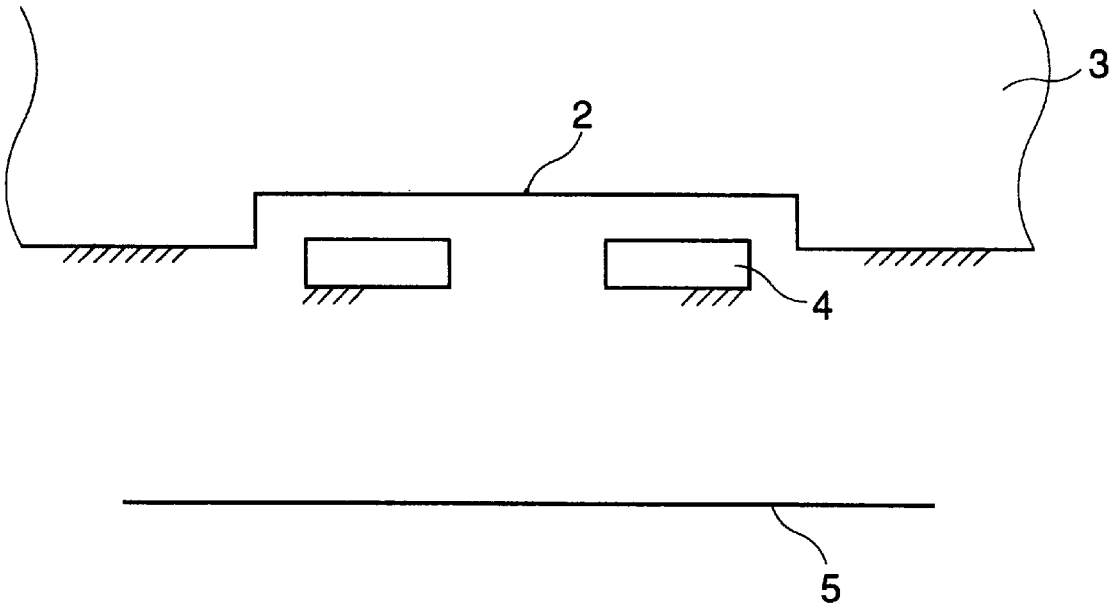
FIG. 8 is a view showing the structure in which a head chip is formed on the portion lowered like a recess with respect to a supporting member as one mode of the first embodiment in accordance with the present invention.

Also, for the structural arrangement of the head in which the head chip 1 portion is lowered like a recess with respect to the supporting member 3, it is possible to obtain the discharge flow effect by the provision of each of the structures 4 as shown in FIG. 8 which is a cross-sectional view showing the circumference of the discharge openings 2 of the head.

More specifically, the length of the head chip 1 is 2.6 mm in the direction x, and the head chip 1 portion is recessed by 0.2 mm with respect to the supporting member 3. The dimension of the structure is the same as that of the embodiment described above.

For the structure thus arranged, the discharge flow effect is also obtainable so that the adhesion of mist is controlled as indicated by the slanted lines in FIG. 8. In this way, it is possible to prevent mist from adhering to the circumference of the discharge openings 2 of the head.

(Embodiment 2)

Figure 9:
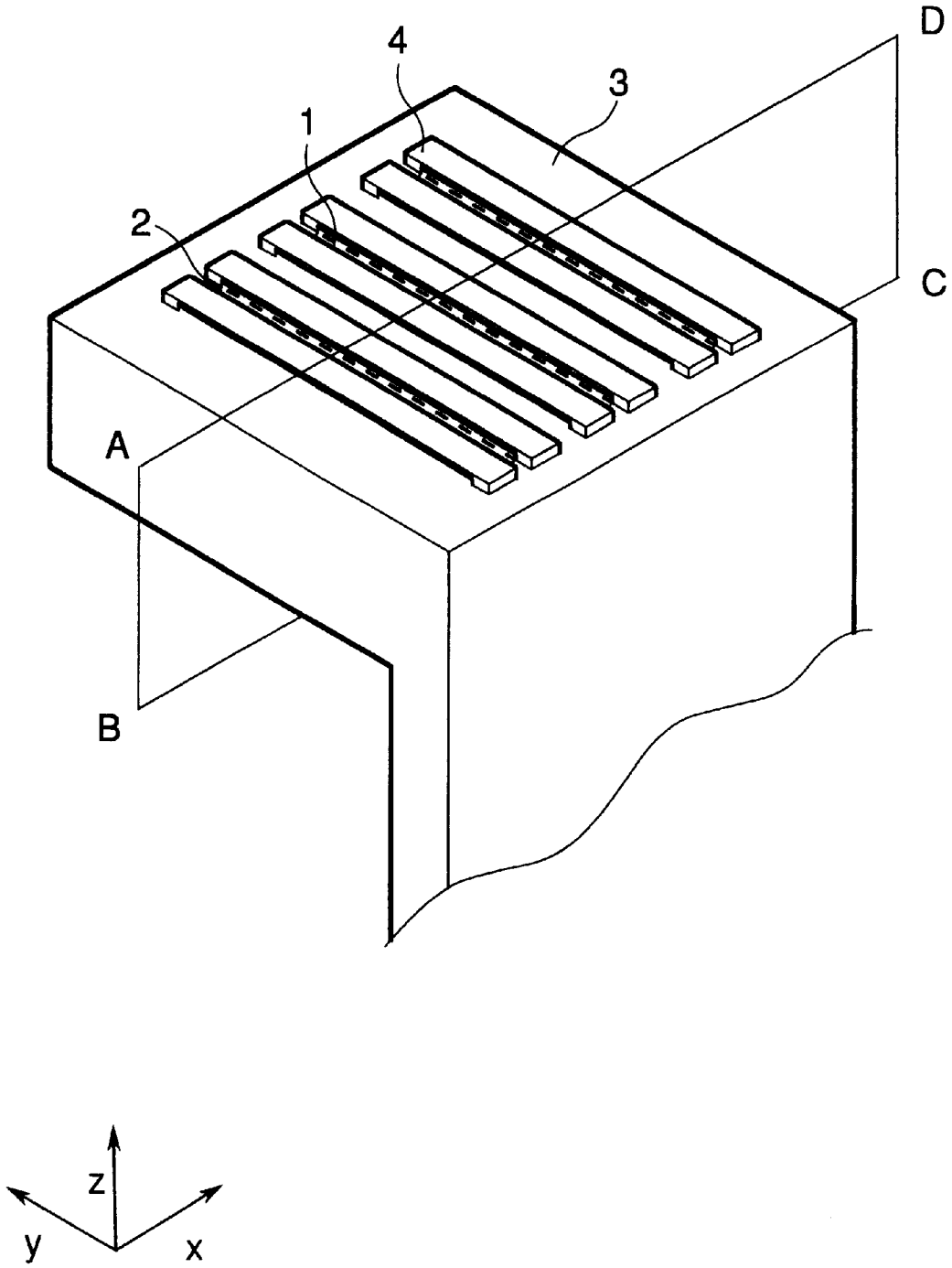
FIG. 9 is a perspective view which shows an ink jet head in accordance with a second embodiment of the present invention.

FIG. 9 is a perspective view which shows an ink jet head in accordance with a second embodiment of the present invention.

Here, a color ink jet apparatus, which uses water proof liquid, is adopted for the present embodiment. Therefore, three head chips 1 are arranged for the ink jet head.

Then, two ink jet heads are installed on the ink jet apparatus of the present embodiment.

Now, in accordance with the present embodiment, the dimension of each structure 4 on the circumference of the facing area of the ink jet head is 0.2 mm thick, 3 mm long in the direction x, and 38 mm long in the direction y. Also, the distance of the gap between the structure 4 and the facing area of the head is 0.1 mm, while the distance between each of the structures 1.0 mm. SUS is used as the material of the structure.

For the ink jet head, the discharge openings 2 are arranged on one head chip 1 in a density of 300 DPI with the discharge volume of 5 $\mu$l at the discharge speed of 15 m/s. Distance between two arrays of the discharge openings is 0.3 mm. 512 openings are arranged in total.

The distance between discharge openings 2 and a paper sheet is 1.5 mm. The driving frequency is 10 kHz.

Figure 10:
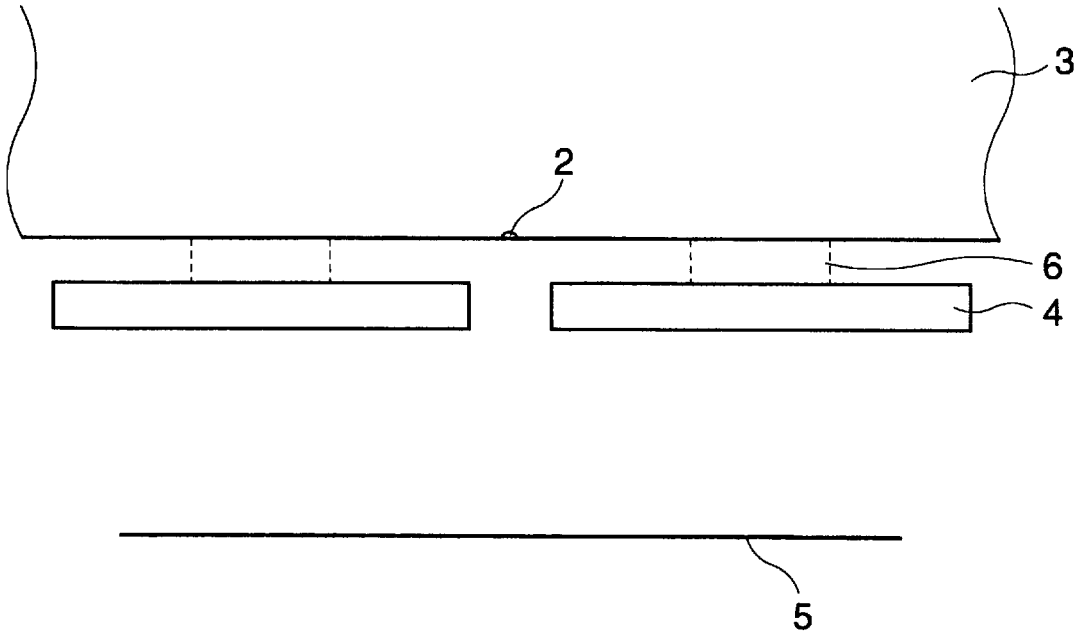
FIG. 10 is a view which shows the ink jet head represented in FIG. 9, taken along the section indicated by marks A, B, C, and D in FIG. 9.

FIG. 10 shows the circumference of discharge openings shown in FIG. 9, taken along the section indicated by marks A, B, C, and D in FIG. 9. For the present embodiment, 512 discharge openings are arranged to discharge ink. Therefore, ribs are provided in the gap of the structures 4 in the direction y to enhance the strength of each of the structures 4. The ribs are indicated by dotted lines in FIG. 10.

Figure 11:
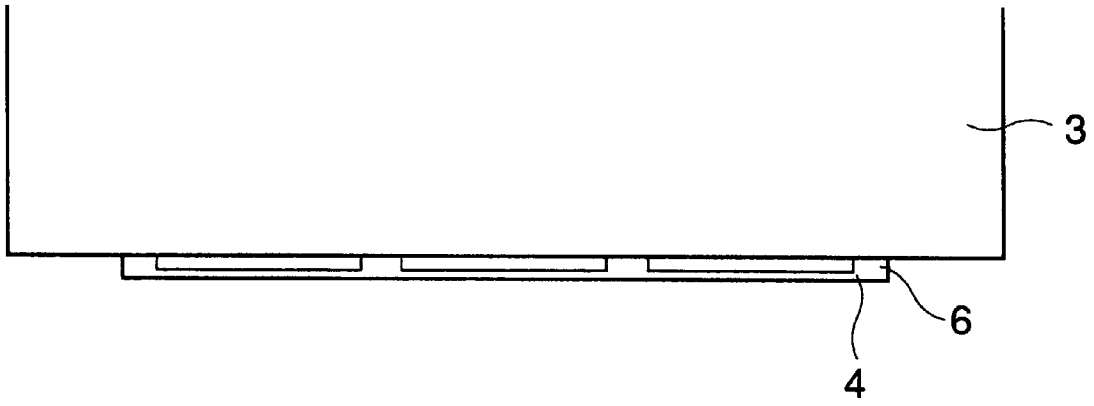
FIG. 11 is a cross-sectional view which shows the ink jet head in accordance with the second embodiment of the present invention.

The length of each rib is 1 mm in the direction x. Here, FIG. 11 is a cross-sectional view which shows the x-y plane of the head. As shown in FIG. 11, the length of one rib is 2 mm in the direction y, and distance between the ribs is 10 mm.

With the structure thus arranged in accordance with the present embodiment, the facing area of the ink jet head is observed after printing. Mist adheres only as shown in FIG. 10.

In other words, mist adheres to the gap between the facing area of the head and each of the structures 4. However, the mist remains in that portion, and it does not allowed to reach the circumference of the discharge openings 2.

Hence, as compared with the ink jet head having no structures 4, it becomes possible to reduce the amount of mist adhering to the circumference of the discharge openings significantly by the discharge flow effect.

In accordance with the present embodiment, the width of each rib in the direction x is made smaller than the width of each structure in the direction x, and ribs are arranged centering on the structure in the direction x. In other words, the discharge flow effect is demonstrated with the structures having ribs in a state where no ribs exist on the discharge opening side of each of the corresponding portions of the structures.

With the structure thus arranged, it is possible to prevent mist from approaching the circumference of discharge openings 2 by means of the discharge flow effect. At the same time, the length of each structure 4 is made 1.5 mm in the direction x so as to prevent mist from entering the gap between the structure 4 and the facing area of the head when discharged droplet is impacted on the surface of paper sheet from the discharge openings of recording means adjacent to that structure.

In this way, it becomes possible to prevent for the ink jet recording that uses water proof liquid to prevent mist from adhering to the circumference of discharge openings 2 of the facing area of the head when the liquid is rebounded at the time of impact. As a result, the impact deviation of droplets and the missing dots can be prevented when printing.

Figure 12:
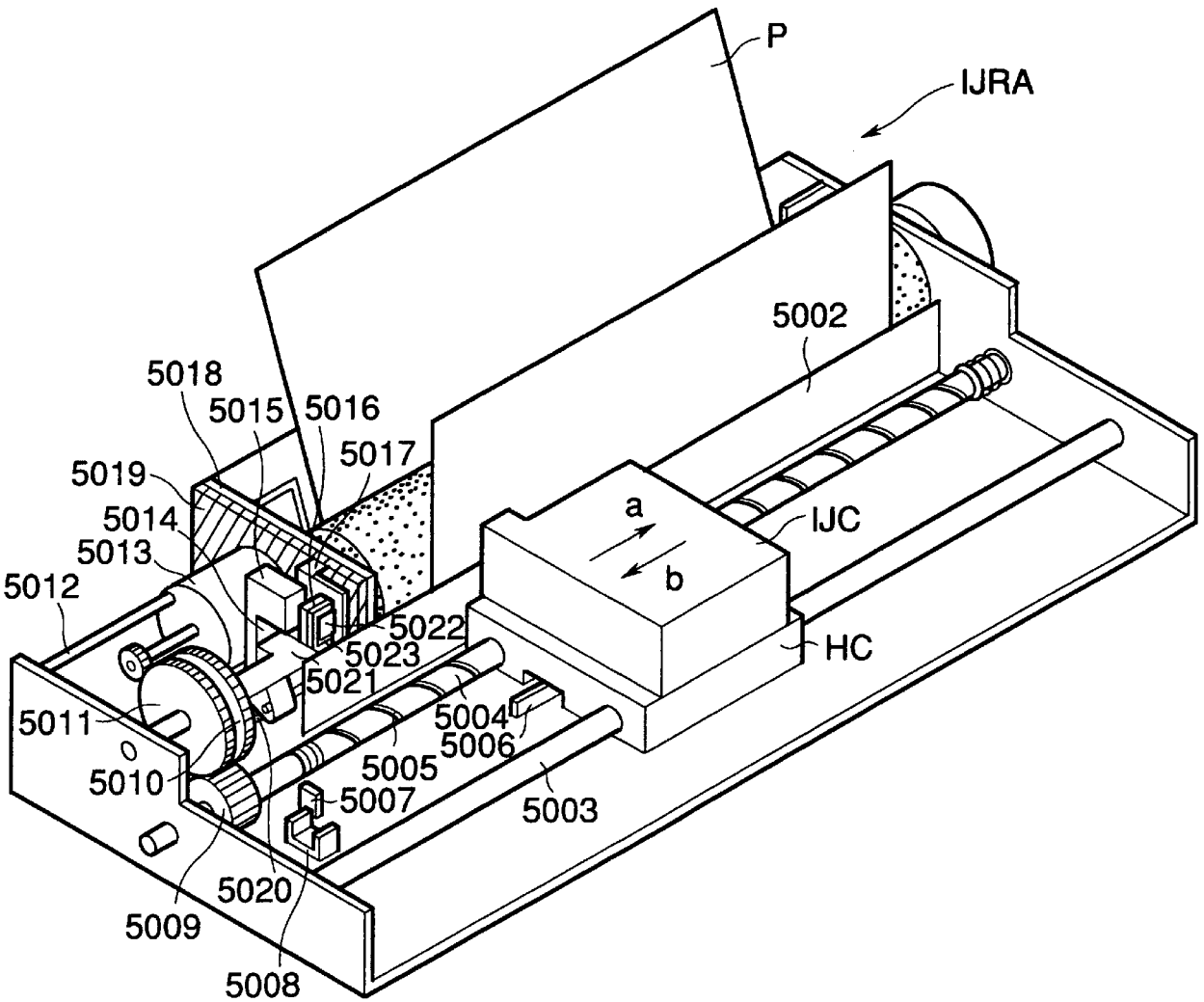
FIG. 12 is a perspective view which schematically shows an ink jet apparatus capable of mounting on it an ink jet head of the present invention.

FIG. 12 is a perspective view which schematically shows the outer appearance of an ink jet apparatus IJA. An ink jet cartridge IJC having an ink jet head and an ink tank integrally formed therefor is mounted on a carriage HC. Interlocked with the regular and reversed rotations of a driving motor 5013, the carriage HC reciprocates in the directions indicated by arrows a and b by means of a pin (not shown) which fitted into a spiral groove 5005 of a lead screw 5004 that rotates through driving power transmission gears 5011 and 5009.

Here, a reference numeral 5002 designates a paper sheet pressure plate that presses a paper sheet to a platen 5000 in the direction of carriage movement; 5007 and 5008, a photocoupler serving as home position detecting means that recognizes and confirms the present of the carriage lever 5006 in the zone covered by the photocoupler, thus switching over the rotational direction of the motor 5013, among some other operations; 5016, a member that supports the capping member 5022 that caps the front surface of the recording head; 5015, suction means for sucking the interior of the cap that performs the suction recovery of the recording head through the aperture 5023 in the cap; 5017, a cleaning blade to wipe the facing area of the head; and 5019, a member that enables the blade to move forward and backward. These devices are supported on the supporting plate 5018 of the main body of the apparatus. Here, the blade is not necessarily configured in this mode. Any one of known cleaning blades is of course applicable to the present embodiment. Also, a reference numeral 5012 designates a lever that is used for starting suction for the suction recovery. This lever moves along the movement of a cam 5020 that engages with the carriage, and the movement thereof is effectuated by the known transmission means, such as clutch type switching, which controls the driving power transmitted from the driving motor.

Here, the arrangement is made to enable the capping, cleaning, and suction recovery to be executed in the corresponding positions as desired by the function of the lead screw 5005 when the carriage HC is positioned in the region on its home position side. However, if these devices are arranged to be operative as desired at known timing, any type of arrangement may be adoptable for the present embodiment.

Also, the description has been made of a cartridge type head, as well as an ink jet apparatus having an integrated ink tank. However, the present invention also includes an ink jet apparatus of such a type that ink is supplied from the ink tank to the recording head by use of extremely fine tubes.

What is claimed is:

1. An ink jet head comprising:

a plurality of discharge openings for discharging ink; and a facing area having said plurality of discharge openings arranged in lines, wherein said facing area is provided with a recessed portion, structures being arranged with a gap over said facing area on both sides of said plurality of discharge openings arranged in lines on said facing area, wherein said plurality of discharge openings and structures are arranged in said recessed portion.

2. An ink jet head according to claim 1, wherein said structures are arranged to extend in the arrangement direction of said discharge openings.

3. An ink jet head according to claim 2, wherein said structures are formed by SUS.

4. An ink jet head according to claim 2, wherein said structures are formed by resin.

5. An ink jet head according to claim 4, wherein said structures are provided with ribs in said gap portion.

6. An ink jet head according to claim 5, wherein each width of said ribs is formed smaller than each width of said structures.

7. An ink jet head according to claim 1, wherein said ink jet head is further provided with electrothermal transducing devices for generating thermal energy to be utilized for discharging ink.

8. An ink jet head according to claim 1, wherein said ink jet head is further provided with the portion for discharging water proof liquid for providing water proof capability by reacting upon ink.

9. An ink jet head according to claim 1, wherein said ink jet head is a color type ink jet head for discharging ink of plural colors.

10. An ink jet apparatus capable of mounting an ink jet head according to claim 1, being provided with head movement means for movably mounting said head.

11. An ink jet apparatus according to claim 10, wherein said ink jet apparatus is further provided with cleaning means for wiping said facing area.

12. An ink jet apparatus according to claim 10, wherein said ink jet head is mounted so as to enable the arrangement direction of said plurality of discharge openings to intersect the direction of movement of said head movement means.

* * * * *